US010136227B2

(12) United States Patent
Andersen et al.

(10) Patent No.: US 10,136,227 B2
(45) Date of Patent: Nov. 20, 2018

(54) METHOD OF SOUND PROCESSING IN A HEARING AID AND A HEARING AID

(71) Applicant: Widex A/S, Lynge (DK)

(72) Inventors: Kristian Timm Andersen, Lyngby (DK); Mike Lind Rank, Farum (DK); Thomas Bo Elmedyb, Herlev (DK)

(73) Assignee: Widex A/S, Lynge (DK)

( * ) Notice: Subject to any disclaimer, the term of this patent is extended or adjusted under 35 U.S.C. 154(b) by 399 days.

(21) Appl. No.: 14/567,469

(22) Filed: Dec. 11, 2014

(65) Prior Publication Data

US 2015/0092966 A1 Apr. 2, 2015

Related U.S. Application Data

(63) Continuation-in-part of application No. PCT/EP2012/061793, filed on Jun. 20, 2012.

(51) Int. Cl.

| | |
|---|---|
| ***H04R 25/00*** | (2006.01) |
| ***H04R 1/10*** | (2006.01) |
| *G10L 25/93* | (2013.01) |

(52) U.S. Cl.

CPC ..... *H04R 25/00* (2013.01); *H04R 1/1091* (2013.01); *H04R 25/353* (2013.01); *G10L 25/93* (2013.01); *H04R 2225/43* (2013.01); *H04R 2430/03* (2013.01)

(58) Field of Classification Search

CPC .... H04R 25/00; H04R 1/1091; H04R 25/353; H04R 2225/43; H04R 2430/03; G10L 25/93

USPC ..... 381/316

See application file for complete search history.

(56) References Cited

U.S. PATENT DOCUMENTS

| | | | | |
|---|---|---|---|---|
| 5,426,702 | A * | 6/1995 | Aarts | H04S 5/00 381/22 |
| 6,289,311 | B1 | 9/2001 | Omori et al. | |
| 2006/0251261 | A1* | 11/2006 | Christoph | H03G 3/32 381/1 |
| 2007/0078645 | A1* | 4/2007 | Niemisto | G10L 21/0208 704/200.1 |
| 2010/0329474 | A1* | 12/2010 | Ura | H04R 3/02 381/71.11 |
| 2011/0064252 | A1 | 3/2011 | Ma et al. | |

(Continued)

FOREIGN PATENT DOCUMENTS

| | | | |
|---|---|---|---|
| DE | 3151352 | A1 | 9/1982 |
| EP | 2383732 | A1 | 11/2011 |

(Continued)

OTHER PUBLICATIONS

Communication dated Mar. 14, 2013 issued by International Searching Authority in counterpart International Application PCT/EP2012/061793 (ISR and Written Opinion).

(Continued)

*Primary Examiner* — Sean H Nguyen
(74) *Attorney, Agent, or Firm* — Sughrue Mion, PLLC

(57) ABSTRACT

A method of processing sound in a hearing aid (100, 300, 400) comprises separating the input transducer signal into a periodic and aperiodic signal for further processing in the hearing aid (100, 300, 400). The invention also provides a hearing aid (100, 300, 400) adapted for carrying out such a method of sound processing.

26 Claims, 3 Drawing Sheets

(56) References Cited

U.S. PATENT DOCUMENTS

| | | | | |
|---|---|---|---|---|
| 2011/0096942 | A1* | 4/2011 | Thyssen | G10L 21/0208 381/94.1 |
| 2011/0255712 | A1* | 10/2011 | Urata | H03G 9/005 381/107 |
| 2012/0008791 | A1 | 1/2012 | Gerkmann et al. | |
| 2012/0128163 | A1* | 5/2012 | Moerkebjerg | H04R 25/407 381/23.1 |
| 2012/0150544 | A1* | 6/2012 | McLoughlin | G10L 25/03 704/262 |
| 2012/0185244 | A1* | 7/2012 | Morita | G10L 25/93 704/207 |
| 2013/0003992 | A1* | 1/2013 | Disch | G10L 21/04 381/119 |
| 2013/0182875 | A1* | 7/2013 | Cederberg | H04R 25/353 381/317 |
| 2013/0195302 | A1* | 8/2013 | Meincke | G10L 21/02 381/321 |
| 2013/0259252 | A1* | 10/2013 | Yasuda | G10K 11/16 381/71.11 |

FOREIGN PATENT DOCUMENTS

| | | | |
|---|---|---|---|
| WO | 2012/076044 | A1 | 6/2012 |
| WO | 2012/076045 | A1 | 6/2012 |

OTHER PUBLICATIONS

James M. Kates, "Digital Hearing Aids" pp. 244-255 (Chapter 8) ISBN 978-1-59756-317-8 Jan. 1, 2008.

* cited by examiner

METHOD OF SOUND PROCESSING IN A HEARING AID AND A HEARING AID

RELATED APPLICATIONS

The present application is a continuation-in-part of application No. PCT/EP2012/061793, filed on Jun. 20, 2012, with the European Patent Office and published as WO-A1-2013189528.

BACKGROUND OF THE INVENTION

1. Field of the Invention

The present invention relates to hearing aids. The invention more specifically relates to a method of sound processing in a hearing aid. The invention also relates to a hearing aid adapted to carry out such sound processing.

In the context of the present disclosure, a hearing aid should be understood as a small, microelectronic device designed to be worn behind or in a human ear of a hearing-impaired user. A hearing aid system may be monaural and comprise only one hearing aid or be binaural and comprise two hearing aids. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more input transducers, typically microphones, a microelectronic circuit comprising a signal processor, and an acoustic output transducer, also referred to as a receiver or a speaker. The signal processor is preferably a digital signal processor. The hearing aid is enclosed in a casing suitable for fitting behind or in a human ear.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit, and to the ear canal. In some modern types of hearing aids a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way it is possible to adjust the input sound signal of each frequency band individually to account for the hearing loss in respective frequency bands. The frequency dependent adjustment is normally done by implementing a band split filter and compressors for each of the frequency bands, so-called band split compressors, which may be summarised to a multi-band compressor. In this way it is possible to adjust the gain individually in each frequency band depending on the hearing loss as well as the input level of the input sound signal in a respective frequency band. For example, a band split compressor may provide a higher gain for a soft sound than for a loud sound in its frequency band.

The filter banks used in such multi-band compressors are well known within the art of hearing aids, but are nevertheless based on a number of tradeoffs. Most of these tradeoffs deal with the frequency resolution as will be further described below.

There are some very clear advantages of having a high resolution filter bank. The higher the frequency resolution, the better individual periodic components can be distinguished from each other. This gives a much finer signal analysis and enables more advanced signal processing such as noise reduction or feedback canceling.

The reasons for wanting a low resolution filter bank are more subtle. One aspect relates to the temporal smearing in the filter bank. Temporal smearing is the result of a wide-band signal exciting several bands in the filter bank, since the time delay of the frequency band varies and therefore the output is temporally smeared when the frequency bands are summed together.

2. The Prior Art

In state of the art hearing aids it is well known to apply the hearing gain based on the frequency and the input level.

It is also well known within the art, to adapt the hearing aid signal processing based on a detection of whether speech is present in the signal. In more advanced systems the signal processing may even be based on whether the speech is voiced or unvoiced.

US-A1-20120008791 discloses a hearing aid with two-stage frequency transformation. Some of the processing, for example the amplification, is carried out after high stopband attenuation in the first stage. An increased frequency resolution is achieved in a second stage before the back-transformation in the first stage, which is favorable for noise reduction, for example.

EP-A1-2383732 discloses a hearing aid including a speech analysis unit, which detects a consonant segment and a vowel segment within a detected sound segment, and a signal processing unit which temporally increments the consonant segment detected by the speech analysis unit and temporally decrements at least one of the vowel segment and the segment acoustically regarded as soundless detected by the speech analysis unit.

It is a feature of the present invention to provide a method of sound processing in a hearing aid that provides improved frequency filtering.

It is another feature of the present invention to provide a method of sound processing in a hearing aid that provides improved speech intelligibility based on a detection of whether voiced or unvoiced speech is present.

It is still another feature of the present invention to provide a method of sound processing in a hearing aid that provides improved frequency transposition in a hearing aid.

It is yet another feature of the present invention to provide a method of sound processing in a hearing aid that provides improved means for estimation of frequencies in a hearing aid signal.

SUMMARY OF THE INVENTION

The invention, in a first aspect, provides a method of processing sound in a hearing aid comprising the steps of providing an electrical input signal, separating the input signal, hereby providing a first sub-signal comprising the periodic part of the input signal and a second sub-signal comprising the aperiodic part, processing the first sub-signal and second sub-signal individually in order to alleviate the hearing deficit of a hearing aid user hereby providing a processed first sub-signal and a processed second sub-signal, and combining the processed first sub-signal with the processed second sub-signal hereby providing an output transducer signal.

This provides an improved method of processing in a hearing aid with respect to frequency filtering, speech intelligibility and frequency transposition.

The invention, in a second aspect, provides a hearing aid comprising an acoustical-electrical input transducer, means for separating an input signal into a periodic sub-signal and an aperiodic sub-signal, a digital signal processor adapted for processing the periodic and aperiodic sub-signal parts separately, means for combining the processed periodic and aperiodic sub-signal parts, and an electrical-acoustical output transducer.

This provides a hearing aid with improved means for frequency filtering, speech intelligibility and frequency transposition.

Further advantageous features appear from the dependent claims.

Still other features of the present invention will become apparent to those skilled in the art from the following description wherein embodiments of the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

In the present context the term periodic signal is to be understood as a signal that can be provided as the output signal from a Linear Predictor having an arbitrary signal as input. Thus in the present context the term periodic signal is to be understood as the output from an algorithm that provides as output signal a prediction of an arbitrary signal input.

In the present context the periodic signal may be provided using any algorithm comprising methods selected from a group comprising: subspace methods, wavelet transforms, discrete Fourier transforms, correlation analysis, harmonic fitting, maximum likelihood methods, cepstral methods, Bayesian estimation and comb filtering.

The term aperiodic signal is understood as the residual signal when subtracting the periodic signal from the input signal. The aperiodic signal may also be denoted a stochastic signal.

Figure 1:
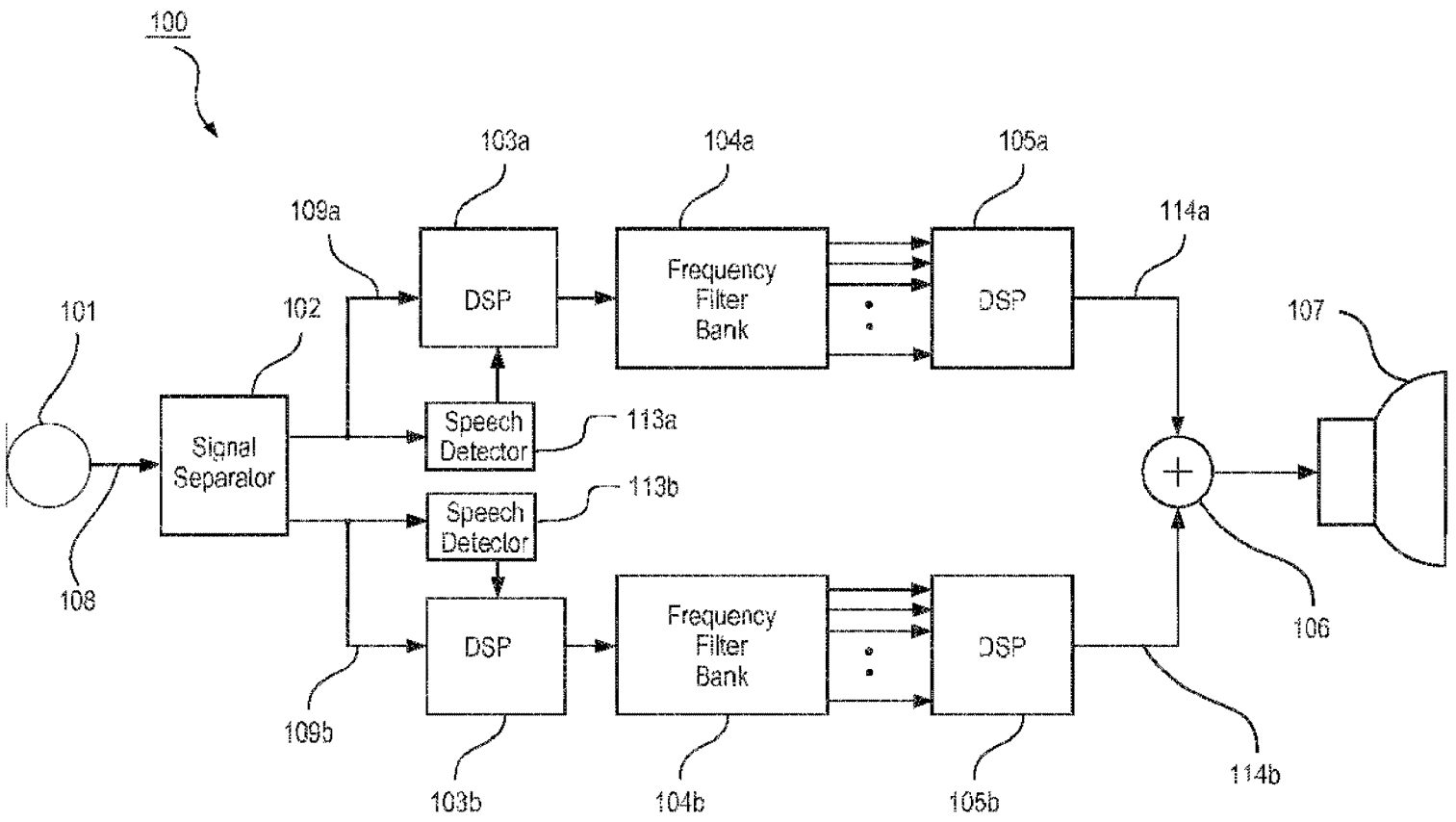
FIG. 1 illustrates highly schematically a hearing aid according to an embodiment of the invention.

Reference is first made to FIG. 1, which illustrates highly schematically a hearing aid according to an embodiment of the invention.

The hearing aid 100 comprises an acoustical-electrical input transducer 101, i.e. a microphone, a signal separator 102, a set of speech detectors 113*a* and 113*b*, a set of first digital signal processors 103*a* and 103*b*, a set of frequency filter banks 104*a* and 104*b*, a set of second digital signal processors 105*a* and 105*b*, a summing unit 106 and an electrical-acoustical output transducer 107, i.e. a speaker.

According to the embodiment of FIG. 1 the microphone 101 provides an analog electrical signal that is converted into a digital signal 108 by an analog-digital converter (not shown) and input to the signal separator 102. The signal separator splits the input signal 108 into a periodic signal 109*a* and an aperiodic signal 109*b* by using a Linear Prediction model. The Linear Prediction model seeks to predict the next sample based on past values according to the formula:

$$y(n) = x(n) + u(n) = \sum_{k=1}^{N} w_k y(n-k) + u(n)$$

Here y(n) is the observed signal, x(n) is the prediction based on the past N values of y(n) and the model parameters $w_k$. u(n) is the residual that the model cannot predict.

According to the embodiment of FIG. 1 the value of y(n) is sampled with a frequency of 32 kHz and the order of the predictor N is selected to be 60. This provides a minimum detectable frequency resolution of approximately 250 Hz. The duration of the window used to calculate the model parameters $w_k$ is 50 ms.

According to variations of the embodiment of FIG. 1 the window length may be in the range of 5-100 ms whereby most audio signals will be quasi stationary. For speech a window length of 15-70 ms is often used. The predictor order may be in the range between 8 and say 512.

According to further variations the predictor order may vary in dependence on the frequency.

The lower limit of the sampling frequency is determined by Nyquist's sampling theorem and the hearing aid bandwidth. The hearing aid bandwidth is typically in the range between say 5 kHz and 16 kHz, providing a critical sampling frequency in the range between 10 and 32 kHz. In the present context it may be appropriate to apply oversampling, thus using a sampling frequency of say 64 kHz or even higher. Hereby the delay of the hearing aid system can be reduced.

The model estimates the parameters $w_k$ that best predict y(n). If y(n) is completely periodic, then the model can predict it given a sufficiently complex model, i.e. a sufficiently high order of N. If y(n) is aperiodic then it cannot be predicted and the residual u(n) will be very large. When y(n) contains both periodic and aperiodic signals, the model should predict the periodic parts in x(n) while u(n) contains the aperiodic parts. In this way y(n) can be separated into a predictable periodic part x(n) and an unpredictable part u(n) that may be denoted the aperiodic or stochastic part.

The inventors have found that this provides an efficient and simple method of also separating voiced and unvoiced sounds of speech, because the periodic signal x(n) will comprise the voiced sounds, and the aperiodic signal u(n) will comprise the unvoiced sounds.

Voiced sound is a term used to describe the part of speech that is created by pushing air through the vibrating vocal chords. These vibrations are highly periodic, and the frequency at which they vibrate is called the fundamental frequency. An often used description is that they correspond to the vowel sounds in speech. This signal is highly periodic and the energy in the power spectrum is localized in a few frequencies spaced evenly apart, known as the fundamental frequency and its harmonic frequencies. In general any signal that has most of its energy localized in a few frequencies will be highly periodic, and in the following, the term "periodic signal" will be used instead of voiced sound as it more precisely describes what attribute of voiced sounds is the key for this separation.

Unvoiced sound is a term used to describe the part of speech that is aperiodic or stochastic on a time scale larger than about 5 milliseconds. It is created in the mouth by air being pushed between the tongue, lips and teeth and is responsible for the so called plosives and sibilants in consonants. Unvoiced sounds are highly random and the energy is spread out over a large frequency range.

Figure 2:
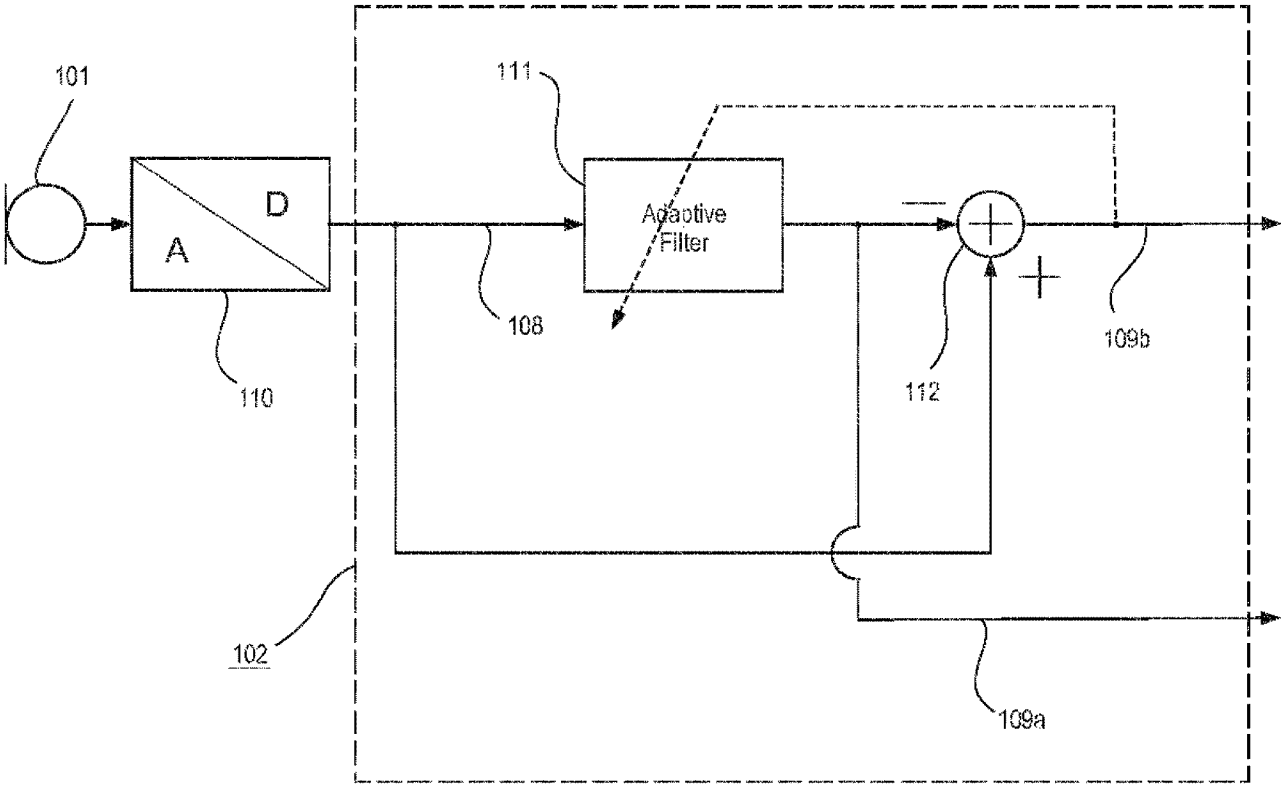
FIG. 2 illustrates highly schematically the signal separator, according to the embodiment of FIG. 1, in greater detail.

According to the embodiment of FIG. 1 the signal separator 102 is implemented as illustrated in FIG. 2.

FIG. 2 illustrates the microphone 101, the analog-to-digital converter (ADC) 110 that for illustrative purposes was not included in FIG. 1, the signal separator 102 comprising an adaptive filter 111 and a subtraction unit 112. The signal separator provides the periodic signal 109*a* and the aperiodic signal 109*b*.

The output of the ADC 110 is operationally connected to the input of the adaptive filter 111 and to a first input of the subtraction unit 112. The output of the adaptive filter, effectively representing the periodic signal 109*a*, branches out into a first branch operationally connected to a second input of the subtraction unit 112, and a second branch that is operationally connected to the remaining signal processing in the hearing aid (not shown in the figure). The output from the subtraction unit 112 provides the aperiodic signal 109*b*, the value of which is calculated as the value of the output signal from the ADC (i.e. the digital input signal) 108 minus the value of the output signal from the adaptive filter (i.e. the periodic signal) 109*a*. The output from the subtraction unit 112 has a branch operationally connected to a control input of the adaptive filter 111.

The adaptive filter 111 functions as a linear predictor, as already described above, that takes a number of delayed samples of the digital input signal 108 as input and tries to find the linear combination of these samples that best "predicts" the latest sample of the digital input signal 108. Hereby, ideally, only the periodic part of the digital input signal 108 is output from the adaptive filter 111.

According to a variation of the embodiment of FIG. 2, the linear prediction is based on an Auto-Regressive Moving-Average (ARMA) model that seeks to predict the next sample based on past values according to the formula:

$$y(n) = x(n) + u(n) = \sum_{k=1}^{N} w_k y(n-k) + \sum_{k=1}^{M} v_k u(n-k) + u(n)$$

According to the embodiment of FIG. 1 the periodic signal 109*a* is provided to a periodic digital signal processor 103*a*, and the aperiodic signal 109*b* is provided to an aperiodic digital signal processor 103*b*, wherein the periodic and aperiodic digital signal processors belong to the set of first digital signal processors referred to earlier. Hereby the aperiodic signal 109*b*, that contains the unvoiced sounds, can be amplified independent of the periodic signal 109*a* that contains the voiced sounds and vice versa.

Unvoiced sounds, like for instance the hard sounds in the consonants S, K and T, can often be difficult to hear in noisy surroundings, as they have a lower sound level than voiced sounds, like vowels. This means that hearing impaired listeners often mistake what consonant is being pronounced and therefore that speech intelligibility is reduced. By separating voiced and unvoiced sounds and individually applying a speech enhancement gain for the unvoiced sounds, speech intelligibility can be improved.

In variations of the embodiment according to FIG. 1 speech intelligibility may also be improved by individually applying a speech enhancement gain for either the voiced sounds alone or for both the voiced and unvoiced sounds.

As the periodic and aperiodic signals 109*a* and 109*b* can also contain other signals than speech, a way to detect when speech is present is generally preferred, in order to avoid altering sounds that are not speech.

A hearing aid speech detector capable of detecting voiced and unvoiced speech independently is described e.g. in patent application PCT/EP2010/069154, published as WO-A1-2012076045, "Hearing Aid and a Method of Enhancing Speech Reproduction".

It is a distinct advantage of the invention that only the unvoiced (or voiced) part of the speech is affected by the enhancement, even if voiced (or unvoiced) speech is present at the exact same time. In situations with just one speaker, unvoiced and voiced sound will typically not be present at the same time, but in the more common situation with multiple speakers (often denoted the cocktail party situation) unvoiced and voiced sound will frequently be present at the same time. Thus the present invention will be especially advantageous in the cocktail party situation.

According to the embodiment of FIG. 1 the speech enhancement gain will depend on the character of the hearing loss to be compensated, the type of speech considered and an estimate of the speech level. The speech enhancement gains may be in the range between 1-20 dB, preferably in the range between 2-10 dB, e.g. in the range of 5-7 dB.

According to the embodiment of FIG. 1 the speed with which a speech enhancement gain is raised is in the range of 400-600 dB/second. Field research has shown that a slower rate of gain increment has a tendency to introduce difficulties in speech comprehension, probably due to the fact that the beginning of certain spoken words may be missed by the gain increment, and a faster rate of gain increment, e.g. 600-800 dB/second, has a tendency to introduce uncomfortable artifacts into the signal, probably due to the transients artificially introduced by the fast gain increment.

However, according to variations of the embodiment of FIG. 1 the speed with which the gain value is raised may be in the range of 20-20 000 dB/s.

According to the embodiment of FIG. 1 a speech enhancement gain is only applied in the aperiodic signal branch, which comprises the unvoiced speech.

According to variations of the embodiment of FIG. 1 a speech enhancement gain may also be applied in the periodic signal branch, which comprises the voiced speech.

According to yet another variation of the embodiment of FIG. 1 a speech enhancement gain is applied in the periodic signal branch, which comprises the voiced speech while a speech enhancement gain is not applied in the aperiodic signal branch, which comprises the unvoiced speech.

According to the embodiment of FIG. 1 the speech enhancement gain is applied to the aperiodic broadband signal 109*b* using the aperiodic signal processor 103*b*. According to variations of the embodiment of FIG. 1 speech enhancement gains may also be applied to the periodic broadband signal 109*a* using the periodic signal processor 103*a*.

According to further variations of the embodiment of FIG. 1 any of the above mentioned speech enhancement gains may be applied in the periodic or in the aperiodic signal branch after the signals have been split into a number of frequency bands by the frequency filter banks 104*a-b*. Hereby the quality of the speech enhancement may be improved by applying the speech enhancement gains selectively in the frequency bands that actually contain speech.

According to yet another variation at least one of the frequency filter banks 104*a-b* may be replaced by a shaping filter incorporating the frequency dependent speech enhancement gain.

In the present context a shaping filter is to be understood as a time-varying filter with a single broadband input and a single broadband output that provides an alternative to a multi-channel compressor.

Such shaping filters are well known within the art of hearing aids, see e.g. chapter 8, especially page 244-255, of the book "Digital hearing aids" by James M. Kates, ISBN 978-1-59756-317-8. According to the embodiment of FIG. 1 a set of speech detectors 113*a* and 113*b* are provided that are adapted to detect voiced and unvoiced speech respectively. The speech detectors are used to control the first set of digital signal processors 103*a* and 103*b*, wherein the speech enhancement gains are applied—as described above.

The inventors have found that another advantageous aspect of the invention is that the performance and robustness of the speech detectors 113*a-b* may be improved by basing the voiced speech detection on the periodic signal 109*a*, and unvoiced speech detection on the aperiodic signal 109*b*, respectively.

According to a variation of the embodiment of FIG. 1, the set of first digital signal processors 103*a-b* and speech detectors 113*a-b* may be omitted. In another variation the digital signal processors 103*a-b* and speech detectors 113*a-b* related to only one of the periodic or aperiodic signal branches are included.

As will be discussed in more detail below, neither speech detectors 113*a-b* nor the set of first digital signal processors 103*a-b* are essential in order to benefit from a signal separation into a periodic and aperiodic signal branch.

According to the embodiment of FIG. 1 the processed (i.e. enhanced) periodic signal and the processed aperiodic signal are provided to a periodic filter bank 104*a* and an aperiodic filter bank 104*b*, respectively.

Generally the hearing aid filter bank splits the signal up into frequency bands and is therefore very important for the signal processing path because it determines what the subsequent hearing aid algorithms have to work with. By ensuring that the filter bank is optimal, the potential for the other hearing aid algorithms that depend on the filter bank output is also improved. When designing a filter bank there are a number of tradeoffs that must be taken into account. Most of these tradeoffs deal with the frequency resolution.

There are some very clear advantages of having a high resolution filter bank. The higher the frequency resolution, the better individual periodic components can be distinguished from each other. This provides a much finer signal analysis and enables more advanced signal processing such as noise reduction or feedback canceling. However, as a high frequency resolution is mostly useful for signals that have a narrow frequency width, it is actually only needed for periodic signals.

As already discussed a low resolution filter bank may help to reduce temporal smearing. Temporal smearing results when a signal is so broadband that it excites several of the frequency bands in the filter bank. Since every frequency band delays the signal with a different amount the aperiodic signal will be smeared out over a large time interval when the frequency bands are summed together. This phenomenon gets worse the more bands the filter bank have and therefore it is important to limit the frequency resolution of the filter bank. The inventors have realized that temporal smearing in hearing aids is primarily critical for aperiodic signals. As opposed to aperiodic signals a periodic signal typically exists only in one frequency band of the filter bank and is therefore not affected by an unequal delay between the frequency bands.

Another reason is related to the desire to reduce frequency overlap. Frequency overlap may result when a fast changing gain is applied. The inventors have found that, for hearing aids, fast changing gains are typically only applied to aperiodic signals. Periodic signals, by definition, repeat their waveform and exhibit very small level changes over time. Consequently only relatively small gain changes are generally needed. Aperiodic signals are, again by definition, unpredictable and can therefore have very large levels changes over short time intervals. This means that aperiodic signals generally need faster gain regulation based on the signal envelope, and frequency overlap due to a high resolution filter bank is typically a greater problem for aperiodic signals. In the present context gain changes may be denoted fast for gain variation speeds larger than say 100 dB/s and level changes may be denoted small for changes smaller than say 5 dB.

It is therefore a distinct advantage of the present invention that the periodic filter bank 104*a* has a higher frequency resolution than the aperiodic filter bank 104*b*, since a high resolution filter bank is mostly useful for periodic signals, while a lower resolution filter bank has advantages for aperiodic signals.

According to the embodiment of FIG. 1 the periodic filter bank 104*a* provides 1024 frequency bands through Fourier transformation of the input signal. The aperiodic filter bank 104*b* provides only 10 frequency bands. According to the embodiment the frequency resolution of the filter banks 104*a-b* is uniform across the hearing aid bandwidth.

In variations of the embodiment of FIG. 1 the aperiodic filter bank 104*b* may provide a number of frequency bands in the range between 3 and 25, and the periodic filter bank 104*a* may provide a number of frequency bands in the range between 8 and 2048 bands, preferably selected so that the critical auditory band resolution is obtained.

According to further variations of the embodiment of FIG. 1 the frequency resolution of the filter banks 104*a-b* may be the same, at least in part of the frequency range of the hearing aid bandwidth. According to still further variations the frequency resolution may be non-uniform in at least a part of the frequency range.

According to yet another variation of the embodiment of FIG. 1, the filter banks 104*a-b* are replaced by time-varying shaping filters that are adapted such that a high order (high frequency resolution) shaping filter processes the periodic signal and a lower order (lower frequency resolution) shaping filter processes the aperiodic signal.

The temporal smearing and frequency overlap are artifacts that result from the use of filter banks. However, it is a general principle (the uncertainty principle), which applies to both filter banks and time-varying shaping filters, that an increase in frequency resolution result in a reduced temporal resolution. The specific implementation of the filter banks 104*a-b* is not essential for the other aspects of the invention.

Thus the speech enhancement gains provided by the digital signal processors 103*a-b* do not require a set of optimized filter banks 104*a-b*, and the optimized filter bank functionality provided by the filter banks 104*a-b* is advantageous whether or not the speech enhancement gain feature is applied.

According to the embodiment of FIG. 1 the outputs from the filter banks 104*a-b* are provided to a set of second digital signal processors 105*a* and 105*b* that provide standard hearing aid processing, including compression and amplification, that is well known within the art of hearing aids. Additionally the set of second digital signal processors 105*a* and 105*b* combine the processed frequency bands of the periodic and aperiodic signals respectively and direct the combined periodic signal 114*a* and combined aperiodic signal 114*b* to the summing unit 106. The summing unit hereafter provides the resultant signal to an electrical-acoustical output transducer 107 (i.e. a speaker). The means for combining the processed frequency bands of the periodic and aperiodic signals and the digital-analog converter means, required between the summing unit 106 and the speaker 107, are not shown in FIG. 1 for reasons of illustrative clarity.

According to a further variation of the embodiment of FIG. 1, the set of second digital signal processors 105*a-b* comprises a frequency transposer. A frequency transposer shifts speech, music or other sounds down in frequency to make it more audible to hearing impaired listeners with a high-frequency hearing loss.

The transposition, however, is very dependent on the characteristics of the signal. If a signal comprising voiced speech is transposed, then formants present in the voiced speech signal will also be transposed and this may lead to a severe loss of intelligibility, since the characteristics of the formants are an important key feature to the speech comprehension process in the human brain.

Unvoiced-speech signals, however, like plosives or fricatives, will typically benefit from transposition, especially in cases where the frequencies of the unvoiced speech signals fall outside the perceivable frequency range of the hearing-impaired user.

By moving the transposition to the periodic (voiced speech) and aperiodic (unvoiced speech) signal paths, voiced and unvoiced signal parts can be shifted individually. This may especially be advantageous in situations with multiple speakers where voiced and unvoiced speech is present at the same time, or in situations with a single speaker and music. In these situations it can be avoided that voiced speech or music is transposed as a consequence of unvoiced speech being present at the same time, because the transposition in the periodic and aperiodic signal paths are controlled independent on each other. Generally it is not desirable to transpose music due to its mainly periodic structure.

The general implementation of a frequency transposer is well known within the art of hearing aids. Further details can be found e.g. in WO-A1-2007/000161 "Hearing aid with enhanced high frequency reproduction and method for processing an audio signal" and in the patent application PCT/EP2010/069145, published as WO-A1-2010076045, "Hearing Aid and a Method of Improved Audio Reproduction".

The frequency transposer does not require the presence of neither the set of first digital signal processors, nor the filter bank as disclosed in FIG. 1, which may in some embodiments be omitted. The advantageous frequency transposer according to the present invention only requires that the input signal is split into a periodic and aperiodic branch and that each branch has its own filter bank.

According to a further advantageous variation of the embodiment of FIG. 1, the frequency estimation is based only on the periodic signal. In current hearing aids frequency estimation is used for a variety of purposes, e.g. in the frequency transposer and the feedback canceller. Generally frequency estimation is used in order to find the most dominant frequency in a signal. By definition, a dominant frequency must be periodic and can therefore only be found in the periodic signal path. By moving the frequency estimators to the periodic signal path, the signal seen by the frequency estimator will be more periodic and hence the estimation can be improved e.g. in cases where stochastic sounds interfere with the periodic signal.

Figure 3:
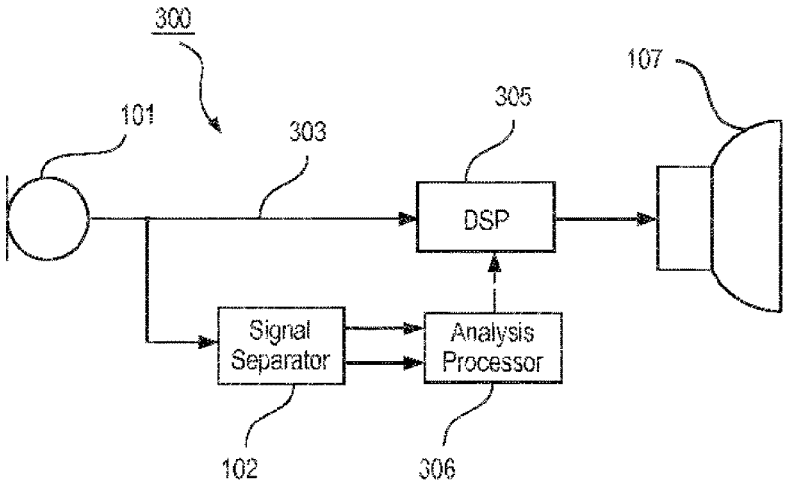
FIG. 3 illustrates highly schematically a hearing aid according to another embodiment of the invention.

Reference is now made to FIG. 3 that highly schematically illustrates a hearing aid 300 according to the present invention where the separated signals form an analysis branch that a variety of algorithms can use to provide improved performance of the hearing aid.

The hearing aid 300 comprises a microphone 101, a signal separator 102, a digital analysis processor 306, a digital hearing aid processor 305 and a hearing aid speaker 107.

According to the embodiment of FIG. 3 the microphone 101 provides an analog electrical input signal that is converted into a digital input signal 303 by an analog-digital converter (not shown). The signal path comprising the digital input signal 303 is branched into an analysis path and a processing path. In the analysis path the digital input signal 303 is input to a signal separator 102. The signal separator separates the digital input signal 303 into a periodic signal and an aperiodic signal in the manner already described with reference to FIG. 1. The periodic and aperiodic signals are subsequently fed to the digital analysis processor 306 that extracts a characteristic feature from at least one of the signals and uses the quantitative or qualitative value of said characteristic value to control the sound processing carried out by the digital hearing aid processor 305 on the digital input signal 303 hereby providing an improved output signal for the hearing aid speaker.

According to a specific implementation of the embodiment of FIG. 3 the digital analysis processor 306 comprises a frequency estimator. Hereby the frequency estimation can be improved by being based on the periodic signal only.

Therefore e.g. frequency transposition and feedback cancellation, carried out by the digital hearing aid processor 305, can also be improved.

According to another specific implementation of the embodiment of FIG. 3 the digital analysis processor 306 comprises a voiced speech detector and an unvoiced speech detector. The voiced speech detection can be improved by applying the voiced speech detector on the periodic signal. The unvoiced speech detection can be improved by applying the unvoiced speech detector on the aperiodic signal. Therefore e.g. frequency transposition and noise reduction, carried out by the digital hearing aid processor 305, can also be improved.

Figure 4:
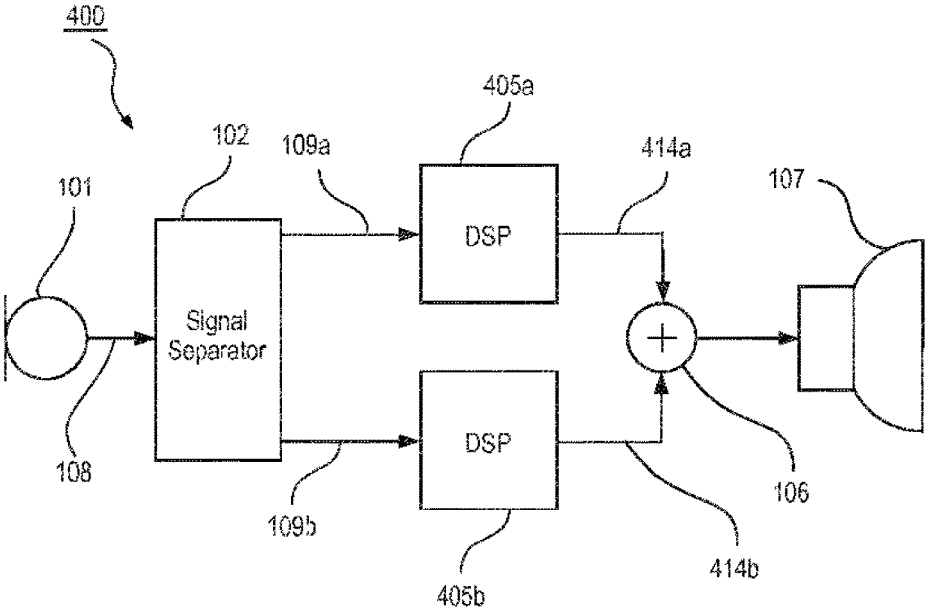
FIG. 4 illustrates highly schematically a hearing aid according to another embodiment of the invention.

Reference is now made to FIG. 4 that highly schematically illustrates a hearing aid 400 according to the most basic form of the present invention.

The hearing aid 400 comprises a microphone 101, a signal separator 102, a digital analysis processor 306, a periodic digital hearing aid processor 405*a*, an aperiodic digital hearing aid processor 405*b*, a summing unit 106 and a hearing aid speaker 107.

According to the embodiment of FIG. 4 the microphone 101 provides an analog electrical input signal that is converted into a digital input signal 108 by an analog-digital converter (not shown). The digital input signal 108 is input to a signal separator 102. The signal separator separates the digital input signal 108 into a periodic signal 109*a* and an aperiodic signal 109*b* in the manner already described with reference to FIG. 1. The periodic 109*a* and aperiodic 109*b* signals are subsequently fed to the periodic digital hearing aid processor 405*a* and the aperiodic digital hearing aid processor 405*b*, respectively. The digital hearing aid processors 405*a-b* provide processed periodic and aperiodic signals 414*a-b* that are combined in summing unit 106 and provided to the hearing aid speaker 107.

By specifically adapting the periodic and aperiodic digital hearing aid processors 405*a-b* to a periodic and aperiodic signal respectively an improved output signal for the hearing aid speaker can be provided.

According to a specific implementation of the embodiment of FIG. 4 the periodic digital hearing aid processor 405*a* comprises a time-varying shaping filter with a higher order than the time-varying shaping filter comprised in the aperiodic digital hearing aid processor 405*b*, whereby the output signal for the hearing aid speaker can be improved.

Other modifications and variations of the structures and procedures will be evident to those skilled in the art.

We claim:

1. A method of processing sound in a hearing aid comprising the steps of: providing an electrical input signal, separating the input signal into a first sub-signal comprising a periodic part of the input signal and a second sub-signal different from said first sub-signal and comprising an aperiodic part, after separation of the input signal into first and second sub-signals, processing the first sub-signal and second sub-signal individually in order to alleviate a hearing deficit of a hearing aid user to thereby provide a processed first sub-signal and a processed second sub-signal, and combining the processed first sub-signal with the processed second sub-signal hereby providing an output transducer signal.

2. The method according to claim 1, wherein the step of processing the first sub-signal and the second sub-signal comprises the steps of:

splitting and filtering the first sub-signal into a first set of frequency band signals, splitting and filtering the second sub-signal into a second set of frequency band signals, combining the first set of frequency band signals hereby providing the processed first sub-signal, and combining the second set of frequency band signals hereby providing the processed second sub-signal.

3. The method according to claim 2, wherein the step of processing the first sub-signal and the second sub-signal comprises the steps of:

shifting a first frequency range of a sub-signal into a second frequency range of the sub-signal, superimposing the frequency-shifted first frequency range of the sub-signal on to the second frequency range of the sub-signal, wherein said shifting and superimposing steps are carried out based exclusively on signals from said first set of frequency band signals, whereby only the periodic part of the input signal is frequency shifted and superimposed.

4. The method according to claim 2, wherein the step of processing the first sub-signal and the second sub-signal comprises the steps of shifting a first frequency range of a sub-signal into a second frequency range of the sub-signal, superimposing the frequency-shifted first frequency range of the sub-signal on to the second frequency range of the sub-signal, wherein said shifting and superimposing steps are carried out based exclusively on signals from said second set of frequency band signals, whereby only the aperiodic part of the input signal is frequency shifted and superimposed.

5. The method according to claim 3 comprising the steps of:

detecting a first dominating frequency, detecting a second dominating frequency, wherein said first frequency range of the sub-signal comprises the first dominating frequency and said second frequency range of the sub-signal comprises the second dominating frequency, determining the presence of a fixed relationship between the first dominating frequency and the second dominating frequency, and controlling the step of shifting the first frequency range in dependence on the fixed relationship between the first dominating frequency and the second dominating frequency.

6. The method according to claim 5, wherein the step of detecting a first dominating frequency is carried out in a frequency band signal of the first set, and wherein the step of detecting a second dominating frequency is carried out in a frequency band signal of the first set.

7. The method according to claim 2, wherein said step of splitting and filtering the first sub-signal provides a set of frequency band signals having a higher frequency resolution than the second set of frequency band signals.

8. The method according to claim 1, comprising the steps of:

filtering the first sub-signal using a first time-varying shaping filter hereby providing a first filtered sub-signal, filtering the second sub-signal using a second time-varying shaping filter hereby providing a second filtered sub-signal, and combining the first filtered sub-signal with the second filtered sub-signal hereby providing the output transducer signal.

9. The method according to claim 8, wherein said filtering of the first sub-signal provides a shaping with a higher frequency resolution than the filtering of the second sub-signal.

10. The method according to claim 1, wherein the second sub-signal is sampled at a higher rate than the first sub-signal.

11. The method according to claim 2, comprising the step of:

detecting a dominating frequency in the first sub-signal or in the first set of frequency band signals.

12. The method according to claim 2, comprising the steps of:

determining if un-voiced speech is present, amplifying the second sub-signal or a frequency band signal from said second set of frequency band signals in response to a detection of un-voiced speech.

13. The method according to claim 2, comprising the step of:

determining if unvoiced speech is present in the second sub-signal or in the second set of frequency band signals.

14. The method according to claim 2, comprising the step of:

determining if voiced speech is present in the first sub-signal or in the first set of frequency band signals.

15. The method according to claim 1, wherein said signal separation is carried out using a linear predictor comprising an adaptive filter.

16. A method according to claim 1, wherein said step of processing the first sub-signal and second sub-signal individually comprises processing each of said first and second sub-signals to compensate for a hearing impairment of the user, to provide hearing-impairment-compensated first and second sub-signals, and said output transducer signal includes said hearing-impairment-compensated first and second sub-signals.

17. A method according to claim 1, wherein said second sub-signal is obtained by subtracting said first sub-signal from the input signal.

18. A method of processing sound in a hearing aid comprising the steps of: providing an input signal, splitting the input signal into a plurality of frequency band signals, separating the plurality of frequency band signals, hereby providing a plurality of first sub-signals each comprising a periodic part of a corresponding one of the frequency band signals and a plurality of second sub-signals each different from said first sub-signals and comprising an aperiodic part of a corresponding one of the frequency band signals, after separation of the plurality of frequency bands into said first and second sub-signals, processing the first sub-signals and the second sub-signals independently in order to alleviate a hearing deficit of a hearing aid user, and combining the plurality of processed first and second sub-signals hereby providing a plurality of processed frequency band signals.

19. A method according to claim 18, wherein said step of processing the first sub-signal and second sub-signal comprises processing each of said first and second sub-signals to compensate for a hearing impairment of the user, to provide hearing-impairment-compensated first and second sub-signals, and wherein each of said processed frequency band signals includes a hearing-impairment-compensated first sub-signal and a hearing-impairment compensated second sub-signal.

20. A method according to claim 18, wherein said second sub-signal is obtained by subtracting said first sub-signal from the input signal.

21. A hearing aid comprising an acoustical-electrical input transducer, a signal separator for separating an input signal into a periodic sub-signal which is a first portion of said input signal and an aperiodic sub-signal which is a second portion of said input signal different from said first portion, a digital signal processor adapted for processing the periodic and aperiodic sub-signal parts separately in order to alleviate a hearing deficit of a hearing aid user, a signal combiner connected to combine the processed periodic and aperiodic sub-signal parts to form an output signal containing processed periodic and aperiodic sub-signal parts, and an electrical-acoustical output transducer producing an acoustic output in accordance with said output signal.

22. The hearing aid according to claim 21, comprising a frequency shifter for shifting and superimposing a first frequency range of a given one of said first and second sub-signals on to a second frequency range of said given sub-signal.

23. The hearing aid according to claim 21, comprising an unvoiced speech detector for detecting unvoiced speech and a gain adjustment component adapted for enhancing the gain applied to the aperiodic sub-signal in response to a detection of unvoiced speech.

24. The hearing aid according to claim 21, comprising a first signal splitter for splitting and filtering the periodic sub-signal into a first set of frequency band signals, and a second signal splitter for splitting and filtering the aperiodic sub-signal into a second a set of frequency band signals, wherein the first set of frequency band signals have a higher frequency resolution than the second set of frequency band signals.

25. A hearing aid according to claim 21, wherein each said processed periodic and aperiodic sub-signal part is processed to compensate for a hearing impairment of a hearing aid user.

26. A hearing aid according to claim 21, wherein said signal separator obtains said second sub-signal by subtracting said first sub-signal from the input signal.

* * * * *